US009335661B2

(12) United States Patent
Kusukawa

(10) Patent No.: US 9,335,661 B2
(45) Date of Patent: May 10, 2016

(54) DEVELOPING DEVICE AND IMAGE FORMING APPARATUS INCLUDING THE SAME

(71) Applicant: KYOCERA Document Solutions Inc., Osaka (JP)

(72) Inventor: Takashi Kusukawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/824,905

(22) Filed: Aug. 12, 2015

(65) Prior Publication Data

US 2016/0048094 A1 Feb. 18, 2016

(30) Foreign Application Priority Data

Aug. 18, 2014 (JP) ..... 2014-165708

(51) Int. Cl.
*G03G 15/08* (2006.01)
*G03G 15/00* (2006.01)
*G03G 15/095* (2006.01)

(52) U.S. Cl.
CPC ..... *G03G 15/0891* (2013.01); *G03G 15/095* (2013.01)

(58) Field of Classification Search
CPC ..... G03G 15/095; G03G 15/0891
See application file for complete search history.

(56) References Cited

U.S. PATENT DOCUMENTS

| | | | | |
|---|---|---|---|---|
| 8,494,400 | B2 | 7/2013 | Kashimoto et al. | |
| 8,965,253 | B2 | 2/2015 | Kusukawa et al. | |
| 2011/0229184 | A1 | 9/2011 | Kashimoto et al. | |
| 2013/0209142 | A1* | 8/2013 | Kusukawa ..... | G03G 15/081 399/274 |

FOREIGN PATENT DOCUMENTS

| | | | |
|---|---|---|---|
| JP | H09-211974 | A | 8/1997 |
| JP | 2011-197285 | A | 10/2011 |
| JP | 2013-190767 | A | 9/2013 |

* cited by examiner

*Primary Examiner* — David Gray
*Assistant Examiner* — Michael Harrison
(74) *Attorney, Agent, or Firm* — Studebaker & Brackett PC

(57) ABSTRACT

A developing device includes a development roller, a toner supply roller, a casing having an inner wall portion facing toward the development roller, a flexible film member, an urging member, a linkage member, and a linkage member driving mechanism. The flexible film member is disposed on the inner wall portion and has ends in a direction of an axis of the development roller that are opposite to each other. The urging member is connected with one of the ends of the film member and pulls the film member. The linkage member is connected with the other of the ends of the film member. The linkage member driving mechanism drives the linkage member in accompaniment to rotation of a gear to intermittently pull the film member, so that the film member reciprocates in directions parallel to the axis of the development roller.

13 Claims, 12 Drawing Sheets

DEVELOPING DEVICE AND IMAGE FORMING APPARATUS INCLUDING THE SAME

INCORPORATION BY REFERENCE

The present application claims priority under 35 U.S.C. §119 to Japanese Patent Application No. 2014-165708, filed Aug. 18, 2014. The contents of this application are incorporated herein by reference in their entirety.

BACKGROUND

The present disclosure relates to a developing device for supplying a developer to an image bearing member and an electrophotographic image forming apparatus including the developing device.

An electrophotographic image forming apparatus irradiates a photosensitive layer constituting a peripheral surface of a photosensitive drum (image bearing member) with light, based on image data obtained through scanning of an original document image or on image data transmitted from an external device such as a computer, to form an electrostatic latent image on the photosensitive drum. A developing device supplies toner to the photosensitive drum on which the electrostatic latent image has been formed to form a toner image. Thereafter, the toner image formed on the photosensitive drum is transferred onto paper (recording medium). The paper onto which the toner image has been transferred is subjected to fixing of the toner image thereon, and then ejected out of the apparatus.

In a known development scheme, a dry toner is used in an image forming apparatus employing an electrophotographic process. The dry toner development scheme uses a two-component developer including a magnetic carrier and a non-magnetic toner. In the two-component developer development scheme, for example, a magnetic roller (toner supplying roller) carries the developer to a development roller that is disposed out of contact with a photosensitive drum (image bearing member). During the above, only the non-magnetic toner is transferred onto the development roller with the magnetic carrier left on the magnetic roller. As a result, a thin layer of toner is formed on the development roller. The non-magnetic toner transferred to the development roller flies to the photosensitive drum due to an alternating electric field in a region where the development roller is opposite to the photosensitive drum (development region). As a result, the electrostatic latent image formed on the photosensitive drum is developed into a toner image.

In recent years, image forming apparatus configuration has become more complicated along with progress toward color printing and high-speed processing. In order to achieve high-speed processing, toner stirring members in developing devices are required to rotate at higher speed. In the above-mentioned two-component developer development scheme, in particular, a magnetic brush is formed on the magnetic roller in a region thereof opposite to the development roller, and the magnetic brush enables only the toner to be transferred onto the development roller. Toner left unused in the development is separated from the development roller. As a result, toner cloud is likely to be generated in or around a region where the development roller is opposite to the magnetic roller. Toner from the toner cloud is accumulated around a bristle cutting blade (controlling blade). The accumulated toner may aggregate and adhere to the development roller to cause an image defect leading to toner peeling.

In order to solve the problem, a developing device includes a flexible sheet member and an elliptical roller that causes swing of the sheet member in a wall portion between the controlling blade and the development region that faces toward the development roller. The sheet member constitutes a portion of an internal surface of the wall section and is swingable in a direction perpendicular to the internal surface of the wall section.

Another development device includes a shaking mechanism that accelerates toner adhering to a wall of the development device in such a direction that the toner is shaken off into a case.

In another development device, a film member is attached to an inner wall portion (sleeve cover) of a developer container disposed opposite to the development roller. While the development roller is rotating, a protrusion formed on an outer circumferential surface of a gear intermittently comes in contact with the film member to oscillate the film member. As a result, toner accumulated on the film member is shaken off.

SUMMARY

A developing device of the present disclosure includes a development roller, a toner supply roller, a controlling blade, a casing, a flexible film member, an urging member, a linkage member, and a linkage member driving mechanism. The development roller is disposed opposite to an image bearing member on which an electrostatic latent image is formed. The development roller has a first axis and supplies a developer to the image bearing member while rotating about the first axis. The toner supply roller is disposed opposite to the development roller. The toner supply roller has a second axis parallel to the first axis and supplies a toner to the development roller while rotating about the second axis. The controlling blade is disposed opposite to the toner supply roller with a predetermined gap therebetween. The casing provides accommodation for the development roller, the toner supply roller, and the controlling blade. The casing has an inner wall portion between the controlling blade and the image bearing member that faces toward the development roller. The flexible film member is disposed on the inner wall portion and elongated in a direction of the first axis. The flexible film member has ends in the direction of the first axis that are opposite to each other. The urging member is connected with one of the ends of the film member and pulls the film member. The linkage member is connected with the other of the ends of the film member in the direction of the first axis. The linkage member driving mechanism is disposed on one gear of a gear train for driving the development roller or the toner supply roller. The linkage member driving mechanism intermittently drives the linkage member in accompaniment to rotation of the gear to intermittently pull the film member in a direction parallel to the direction of the first axis and opposite to a direction in which the urging member pulls the film member, so that the film member reciprocates in directions parallel to the direction of the first axis.

An image forming apparatus of the present disclosure includes the above-described developing device.

DETAILED DESCRIPTION

Figure 1:
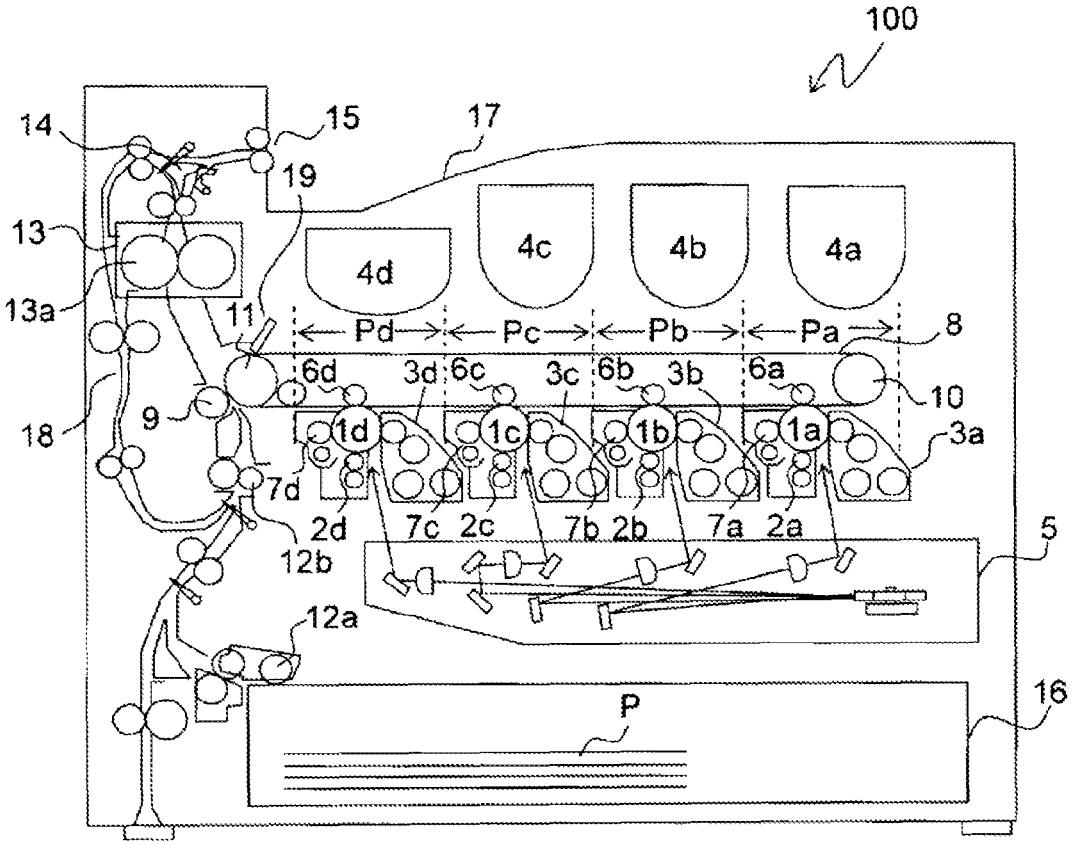
FIG. 1 is a diagram illustrating general configuration of an image forming apparatus including developing devices of the present disclosure.

Hereinafter, embodiments of the present disclosure will be described with reference to the accompanying drawings. FIG. 1 is a schematic cross-sectional view of an image forming apparatus 100 including developing devices 3*a* to 3*d* of the present disclosure. The image forming apparatus 100 herein is a tandem color printer. The color printer 100 includes, in a main body thereof, an intermediate transfer belt 8 and four image forming sections Pa, Pb, Pc, and Pd. The intermediate transfer belt 8 is disposed opposite to the image forming sections Pa, Pb, Pc, and Pd. The intermediate transfer belt 8 is driven by a drive member (not shown) to rotate in a clockwise direction in FIG. 1. Typically, a seamless belt formed from a dielectric resin sheet is used for the intermediate transfer belt 8.

The image forming sections Pa, Pb, Pc, and Pd are arranged in the stated order from an upstream end (right-hand side of FIG. 1) of a region where the intermediate transfer belt 8 is opposite to the image forming sections Pa to Pd in terms of a traveling direction of the intermediate transfer belt 8. The image forming sections Pa to Pd are provided to form images of four different colors (cyan, magenta, yellow, and black, respectively). The image forming sections Pa to Pd sequentially form a cyan image, a magenta image, a yellow image, and a black image, respectively, through charging, light exposure, development, and transfer processes.

The image forming sections Pa to Pd include photosensitive drums 1*a*, 1*b*, 1*c*, and 1*d*, respectively, that each carry a visible image (toner image) of the corresponding color. In the present embodiment, the image formation processes are performed on the respective photosensitive drums 1*a* to 1*d* while the photosensitive drums 1*a* to 1*d* are rotating in a counterclockwise direction in FIG. 1. In primary transfer, the toner images formed on the photosensitive drums 1*a* to 1*d* are sequentially transferred to and superimposed on the intermediate transfer belt 8 traveling in contact with the respective photosensitive drums 1*a* to 1*d*. In secondary transfer, the toner images transferred to the intermediate transfer belt 8 are transferred to paper P, which is an example of a recording medium, by the action of a secondary transfer roller 9. The paper P having the toner images transferred thereto goes through a fixing section 13 where the toner images are fixed, and is then ejected out of the main body of the color printer 100.

The paper P that is to receive secondary transfer of toner images is stored in a paper feed cassette 16 disposed in a lower part of the main body of the color printer 100. The paper P stored in the paper feed cassette 16 is conveyed to a nip (secondary transfer nip) formed between the secondary transfer roller 9 and a drive roller 11 via a paper feed roller 12*a* and a registration roller pair 12*b*. A blade-like belt cleaner 19 that removes toner left on a surface of the intermediate transfer belt 8 is disposed at a location downstream of the secondary transfer nip in terms of the traveling direction of the intermediate transfer belt 8.

Next, the image forming sections Pa to Pd will be described. Chargers 2*a*, 2*b*, 2*c*, and 2*d* that charge the photosensitive drums 1*a* to 1*d;* developing devices 3*a*, 3*b*, 3*c*, and 3*d* that form toner images on the photosensitive drums 1*a* to 1*d;* and cleaning sections 7*a*, 7*b*, 7*c*, and 7*d* that remove developer (toner) left on the photosensitive drums 1*a* to 1*d* are provided around the photosensitive drums 1*a*, 1*b*, 1*c*, and 1*d*, respectively. Furthermore, a light-exposure device 5 that exposes the respective photosensitive drums 1*a* to 1*d* with light based on image data is disposed under the photosensitive drums 1*a* to 1*d*.

First, upon input of image data from a higher-level device such as a personal computer, the chargers 2*a* to 2*d* uniformly charge surfaces of the respective photosensitive drums 1*a* to 1*d*. Next, the light-exposure device 5 irradiates (exposes) the respective photosensitive drums 1*a* to 1*d* with (to) light based on the image data to form electrostatic latent images on the photosensitive drums 1*a* to 1*d* based on the image data. Specified amounts of two-component developers containing cyan, magenta, yellow, and black toners are contained in the developing devices 3*a*, 3*b*, 3*c*, and 3*d*, respectively. The toners included in the two-component developers are supplied by the developing devices 3*a* to 3*d* onto the photosensitive drums 1*a* to 1*d* and adhere to the photosensitive drums 1*a* to 1*d* due to electrostatic force. Thus, toner images of the respective colors are formed corresponding to the electrostatic latent images formed on the photosensitive drums 1*a* to 1*d* by the light-exposure device 5. In a situation in which the percentage of the toner included in the two-component developer contained in the developing device 3*a*, 3*b*, 3*c*, or 3*d* falls below a specified value, a corresponding toner container (replenishing member) 4*a*, 4*b*, 4*c*, or 4*d* replenishes the developing device 3*a*, 3*b*, 3*c*, or 3*d* with the toner.

After formation of the toner images of the respective colors on the photosensitive drums 1*a* to 1*d*, primary transfer is performed in which the toner images are transferred to the intermediate transfer belt 8. More specifically, a specified transfer voltage is applied to primary transfer rollers 6*a* to 6*d*, and an electric field is formed between each of the primary transfer rollers 6*a* to 6*d* and the corresponding one of the photosensitive drums 1*a* to 1*d*. As a result, the cyan, magenta, yellow, and black toner images formed on the photosensitive drums 1*a* to 1*d* are transferred to the intermediate transfer belt 8. The toner images of the four colors to be superimposed on one another are formed in a positional relationship predetermined for formation of a specified full-color image. After the primary transfer, the cleaning sections 7*a* to 7*d* remove toner and other foreign matter left on the surfaces of the photosensitive drums 1*a* to 1*d* in preparation for subsequent formation of new electrostatic latent images.

The intermediate transfer belt 8 is wound around a driven roller 10 upstream and the drive roller 11 downstream in terms of the traveling direction in a region opposite to the photosensitive drums 1*a* to 1*d*.

The drive roller 11 is driven to rotate by a drive motor (not shown). The paper P is conveyed from the registration roller pair 12*b* to the secondary transfer nip at a specific timing while the intermediate transfer belt 8 is rotating in the clockwise direction in FIG. 1 in accompaniment to the rotation of the drive roller 11. Then, the secondary transfer is performed in which the toner images transferred to the intermediate transfer belt 8 are transferred to the paper P. The paper P having the toner images transferred thereto is conveyed to the fixing section 13.

Heat and pressure are applied by a fixing roller pair 13*a* to the paper P conveyed to the fixing section 13 so that the toner images are fixed on a surface of the paper P. Thus, a specified full-color image is formed. The conveyance direction of the paper P having the full-color image formed thereon is switched by a diverging section 14 diverging in a plurality of directions. For printing in which an image is formed only on one side of a sheet of paper P, the paper P that has passed through the fixing section 13 is directly ejected to an exit tray 17 by ejection rollers 15.

For printing in which images are formed on both sides of a sheet of paper P, the paper P that has passed through the fixing section 13 is initially conveyed toward the ejection rollers 15. Once a trailing end of the paper P passes the diverging section 14, the rotation of the ejection rollers 15 is reversed, and at the same time, the diverging section 14 switches the conveyance direction. Consequently, the paper P is guided into a reverse conveyance path 18 with the trailing end thereof in the lead and conveyed back to the secondary transfer nip with the orientation of a printed side thereof reversed. Then, secondary transfer is performed in which next toner images formed on the intermediate transfer belt 8 are transferred to an unprinted side of the paper P by the secondary transfer roller 9. The paper P having the toner images transferred thereto is conveyed to the fixing section 13 where the toner images are fixed, and then ejected onto the exit tray 17.

Figure 2:
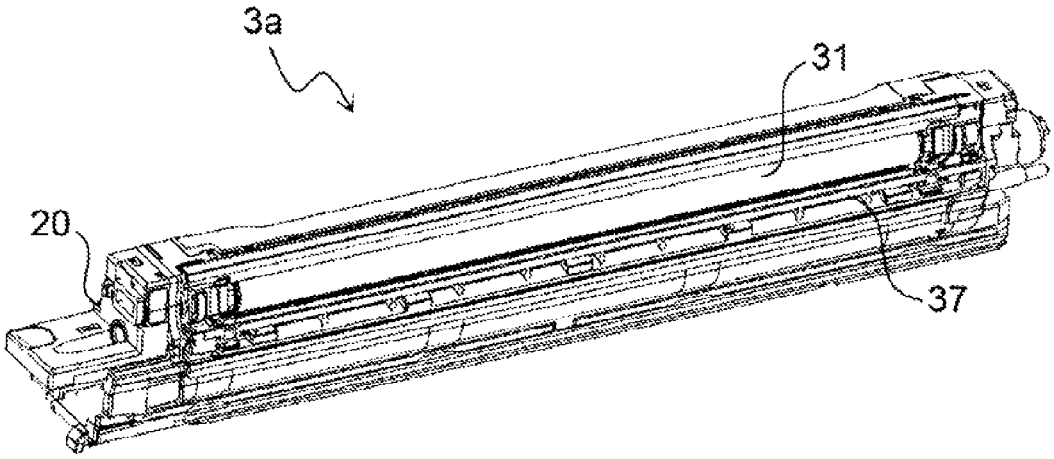
FIG. 2 is a perspective view of a developing device according to a first embodiment of the present disclosure.
Figure 3:
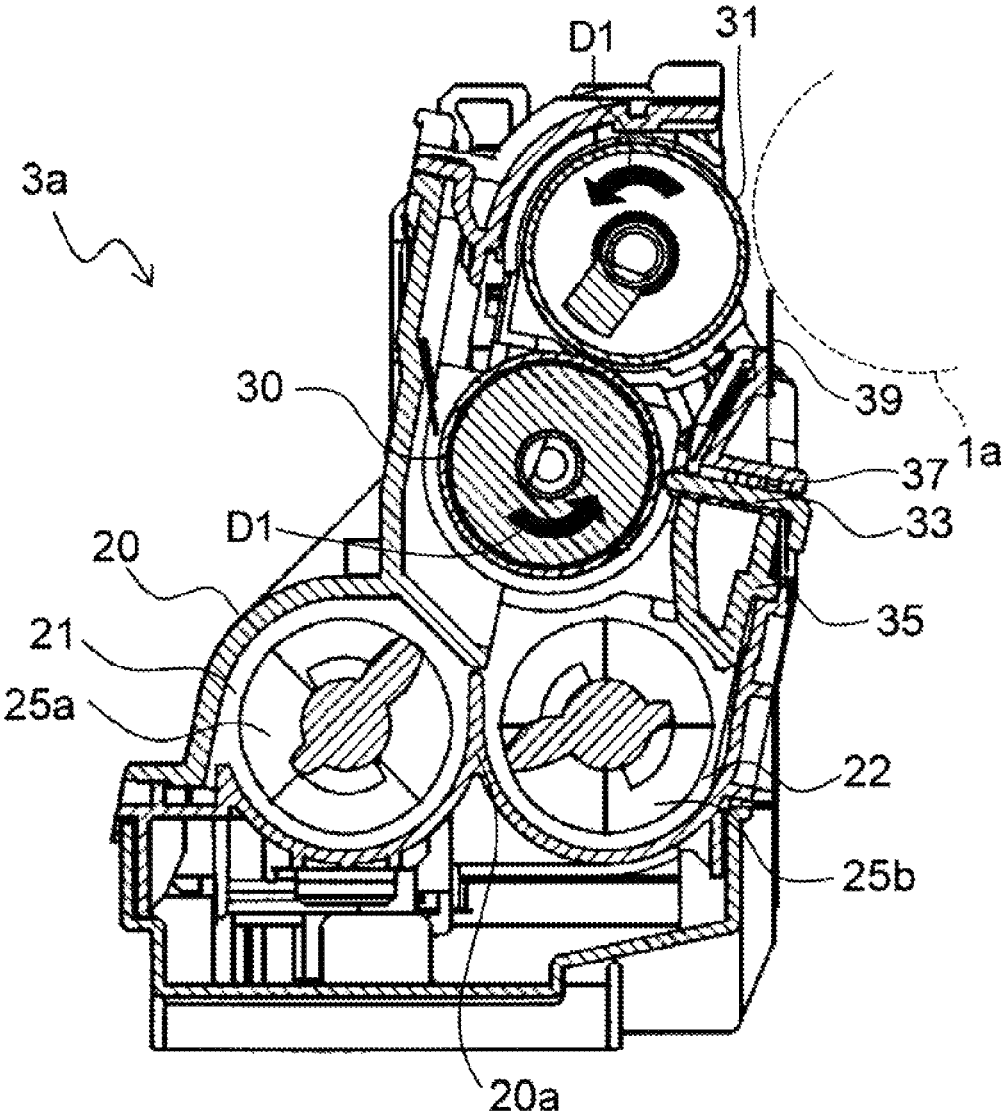
FIG. 3 is a side cross-sectional view of the developing device of the first embodiment.

FIG. 2 is an external perspective view of the developing device 3*a* according to a first embodiment of the present disclosure. FIG. 3 is a schematic cross-sectional side view of the developing device 3*a* of the first embodiment. The photosensitive drum 1*a* is depicted by a dashed line in FIG. 3 in order to assist with understanding. A distance between the photosensitive drum 1*a* and a development roller 31 illustrated in FIG. 3 is not true to scale. In addition, FIG. 3 shows the developing device 3*a* as viewed from a back side of FIG. 1, and thus the arrangement of the elements in the developing device 3*a* shown in FIG. 3 has right and left reversed relative to those of the arrangement shown in FIG. 1. Furthermore, in the following description, the developing device 3*a* disposed in the image forming section Pa in FIG. 1 is used as an example. Since basic configuration of the developing devices 3*b* to 3*d* disposed in the image forming sections Pb to Pd is the same as that of the developing device 3*a*, description thereof will be omitted. In the following description, a fore side of the main body of the color printer 100 is referred to as a front side, and a back side of the main body of the color printer 100 is referred to as a rear side. For example, in FIG. 2, a left end of the developing device 3*a* is at the front side, and a right end thereof is at the rear side.

As illustrated in FIGS. 2 and 3, the developing device 3*a* includes a developer container (casing) 20 in which a two-component developer (hereinafter, may be referred to simply as a developer) is contained. The two-component developer includes a toner and a carrier. The developer container 20 is divided by a partition wall 20*a* into a stirring conveyance chamber 21 and a supplying conveyance chamber 22. A stirring conveyance screw 25*a* is rotatably disposed in the stirring conveyance chamber 21. A supplying conveyance screw 25*b* is rotatably disposed in the supplying conveyance chamber 22. The stirring conveyance screw 25*a* and the supplying conveyance screw 25*b* mix and stir the toner (positively chargeable toner) and the carrier supplied from the toner container 4*a* (see FIG. 1) to the developer container 20. As a result, the toner is charged.

The developer is conveyed in an axial direction of the stirring conveyance screw 25*a* and the supplying conveyance screw 25*b* (in a direction perpendicular to the page of FIG. 3) while being stirred by the stirring conveyance screw 25*a* and the supplying conveyance screw 25*b*. Thus, the developer is circulated between the stirring conveyance chamber 21 and the supplying conveyance chamber 22 through developer carrying paths, not shown, formed at opposite ends of the partition wall 20*a*. That is, the stirring conveyance chamber 21, the supplying conveyance chamber 22, and the developer carrying paths form a circulation path of the developer in the developer container 20.

The developer container 20 extends obliquely toward the upper right in FIG. 3. A toner supply roller 30 is disposed above the supplying conveyance screw 25*b* in the developer container 20. The development roller 31 is disposed at the upper right of the toner supply roller 30. The development roller 31 is opposite to the toner supply roller 30 with a predetermined gap therebetween. The development roller 31 is opposite to the photosensitive drum 1*a* with an opening (right-hand side of FIG. 3) of the developer container 20 therebetween. The development roller 31 and the photosensitive drum 1*a* have a predetermined gap therebetween.

The toner supply roller 30 and the development roller 31 each have a rotational axis. The rotational axis of the toner supply roller 30 is parallel to the rotational axis of the development roller 31. The toner supply roller 30 and the development roller 31 independently rotate about their own rotational axes in a direction indicated by arrow D1 (in a counterclockwise direction in FIG. 3). The rotational axis of the development roller 31 is an example of the first axis, and the rotational axis of the toner supply roller 30 is an example of the second axis.

The stirring conveyance chamber 21 is provided with a toner concentration sensor, not shown, facing toward the stirring conveyance screw 25*a*. Toner is supplied from the toner container 4*a* to the stirring conveyance chamber 21 through a toner supply opening, not shown, based on a result of detection that is performed by the toner concentration sensor. For example, a magnetic permeability sensor that detects a magnetic permeability of the two-component developer including the toner and the carrier contained in the developer container 20 is used for the toner concentration sensor.

The toner supply roller 30 is a magnetic roller. More specifically, the toner supply roller 30 includes a non-magnetic rotational sleeve that rotates in the direction indicated by arrow D1 and a stationary magnetic body that has a plurality of magnetic poles and is included in the rotational sleeve. The toner supply roller 30 carries the developer thereon.

The development roller 31 is a magnetic roller. More specifically, the development roller 31 includes a cylindrical development sleeve that rotates in the direction indicated by arrow D1 and development roller magnetic poles fixed in the development sleeve. The magnetic poles in the development roller are disposed opposite to the plurality of magnetic poles of the stationary magnetic body. Each of the magnetic poles in the development roller has a polarity opposite to a polarity of the corresponding magnetic pole (main pole) of the stationary magnetic body. The development roller 31 carries the developer thereon.

Furthermore, a bristle cutting blade (controlling blade) 33 is provided in the developer container 20, extending in an axial direction of the toner supply roller 30 (in the direction perpendicular to the page of FIG. 3). More specifically, the bristle cutting blade 33 is fastened to a blade supporting frame strut 35 attached to the developer container 20 with a fastening screw (not shown). The bristle cutting blade 33 is located upstream of a region where the toner supply roller 30 is opposite to the development roller 31 in terms of a rotation direction of the toner supply roller 30 (in the counterclockwise direction in FIG. 3). There is a small gap between a tip of the bristle cutting blade 33 in terms of a direction perpendicular to the axial direction of the toner supply roller 30 and a surface of the toner supply roller 30.

A direct-current voltage (hereinafter, referred to as Vslv (DC)) and an alternating-current voltage (hereinafter, referred to as Vslv (AC)) are applied to the development roller 31. A direct-current voltage (hereinafter, referred to as Vmag (DC)) and an alternating-current voltage (hereinafter, referred to as Vmag (AC)) are applied to the toner supply roller 30. The direct-current voltages and the alternating-current voltages are applied to the development roller 31 and the toner supply roller 30 from a development bias power source (not shown) via a bias control circuit (not shown).

As described above, the developer is circulated between the stirring conveyance chamber 21 and the supplying conveyance chamber 22 in the developer container 20 while being stirred by the stirring conveyance screw 25*a* and the supplying conveyance screw 25*b*, and thus the toner included in the developer is charged. The developer in the supplying conveyance chamber 22 is conveyed to the toner supply roller 30 by the supplying conveyance screw 25*b*. As a result, a magnetic brush (not shown) is formed on the toner supply roller 30. The thickness of a layer of the magnetic brush formed on the toner supply roller 30 is controlled by the bristle cutting blade 33. Thereafter, the magnetic brush is conveyed to the region where the toner supply roller 30 is opposite to the development roller 31 as the toner supply roller 30 rotates. Then, Vmag (DC) is applied to the toner supply roller 30, and Vslv (DC) is applied to the development roller 31 to generate a potential difference ΔV and a magnetic field between the toner supply roller 30 and the development roller 31. As a result, a thin layer of toner is formed on the development roller 31.

The thickness of the toner layer on the development roller 31 varies according to factors such as the resistance of the developer and a rotational speed difference between the toner supply roller 30 and the development roller 31. The thickness can also be adjusted by controlling ΔV. The thickness of the toner layer on the development roller 31 is increased by increasing ΔV and decreased by decreasing ΔV. In general, an appropriate range of ΔV in the development is approximately 100 V to 350 V.

The toner thin layer formed on the development roller 31 is conveyed to a region where the development roller 31 is opposite to the photosensitive drum 1*a* with the rotation of the development roller 31. As described above, Vslv (DC) and Vslv (AC) are applied to the development roller 31. A potential difference between the development roller 31 and the photosensitive drum 1*a* causes the toner to fly from the development roller 31 to the photosensitive drum 1*a*, and the electrostatic latent image on the photosensitive drum 1*a* is developed with the toner.

Toner left unused in the development is conveyed to the region where the development roller 31 is opposite to the toner supply roller 30 with the rotation of the development roller 31, and then collected by the magnetic brush formed on the toner supply roller 30. The magnetic brush is separated from the toner supply roller 30 at a region of the stationary magnetic body where adjacent homopolar magnetic poles are included, and then falls off into the supplying conveyance chamber 22.

Thereafter, a specified amount of toner is supplied to the developer container 20 from the toner supply opening (not shown) based on a result of detection by the toner concentration sensor (not shown). As a result, the two-component developer has the toner concentration returned to an appropriate concentration and the toner charged uniformly while being circulated between the supplying conveyance chamber 22 and the stirring conveyance chamber 21. This developer is supplied onto the toner supply roller 30 by the supplying conveyance screw 25*b* to form a magnetic brush, and then conveyed to the bristle cutting blade 33.

A sleeve cover 37 is provided at a right-side wall of the developer container 20 in FIG. 3 in the vicinity of the development roller 31. The sleeve cover 37 has a substantially V-shaped cross-section protruding toward the interior of the developer container 20. More specifically, the sleeve cover 37 illustrated in FIG. 3 is elongated in an axial direction of the development roller 31 (in the direction perpendicular to the page of FIG. 3). The sleeve cover 37 has an upper surface 37*a* (see FIG. 4) constituting an inner wall portion of the developer container 20 and facing toward the development roller 31.

An upper end of the sleeve cover 37 is provided with a sheet-like seal member 39. The seal member 39 extends in the axial direction of the development roller 31. That is, the seal member 39 has a longitudinal direction in the axial direction of the development roller 31 and a lateral direction in a direction perpendicular to the axial direction. An edge of the seal member 39 in the lateral direction is in contact with the surface of the photosensitive drum 1*a* (see FIG. 1). The seal member 39 has a function of blocking leaking of the toner out of the developer container 20.

Figure 4:
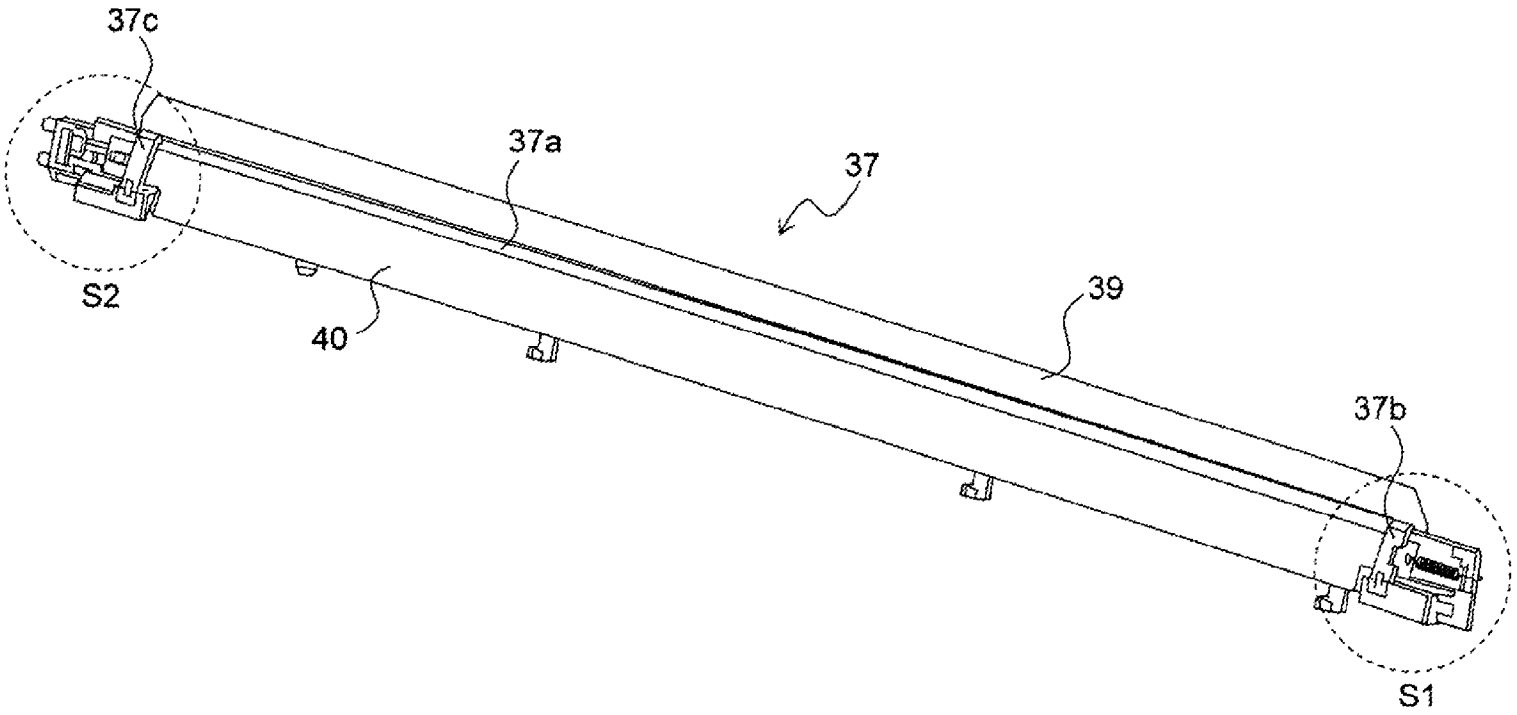
FIG. 4 is a perspective view of a sleeve cover that is used in the developing device of the first embodiment as viewed from the interior of a developer container.

FIG. 4 is a perspective view of the sleeve cover 37 as viewed from the interior (left-hand side of FIG. 3) of the developer container 20. The upper surface 37*a* of the sleeve cover 37 supports a film member 40 elongated in the axial direction of the development roller 31. As illustrated in FIG. 4, the film member 40 is disposed over substantially the entirety of the upper surface 37*a* of the sleeve cover 37 (over an area opposite to the entirety of the development roller 31 in terms of the axial direction). That is, the film member 40 has a longitudinal direction in the axial direction of the development roller 31. In the present embodiment, the film member 40 is formed from a flexible resin material such as a PET film. Preferably, the film member 40 is made more resistant to toner adhesion than the sleeve cover 37 by forming the film member 40 using a fluororesin film or coating the film member 40 with fluororesin. The film member 40 needs to have a certain degree of resilience (elasticity) in order to be capable of the later-described reciprocating movement under tension.

Ends of the upper surface 37*a* of the sleeve cover 37 in terms of the axial direction of the development roller 31, that is, a front-side end (right-hand end in FIG. 4) and a rear-side end (left-hand end in FIG. 4) of the upper surface 37*a* include guide portions 37*b* and 37*c*, respectively. The guide portions

37*b* and 37*c* receive insertion of ends of the film member 40 in terms of the longitudinal direction thereof (rear-side end and front-side end), respectively. The rear-side end of the film member 40 extends toward the rear side farther from the guide portion 37*c*. More specifically, an edge of the rear-side end of the film member 40 is in the vicinity of an idler gear 41 (see FIG. 6). The idler gear 41 is disposed at the rear side of the developing device 3*a* and transmits driving force to a drive input gear of the development roller 31.

Figure 5:
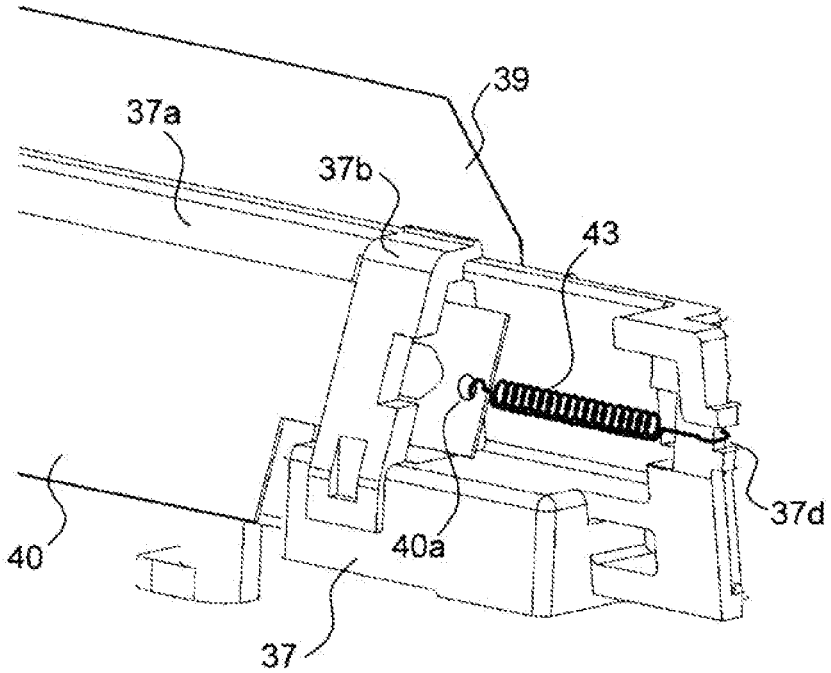
FIG. 5 is an enlarged view of a part around a front-side end of the sleeve cover that is used in the developing device of the first embodiment.
Figure 6:
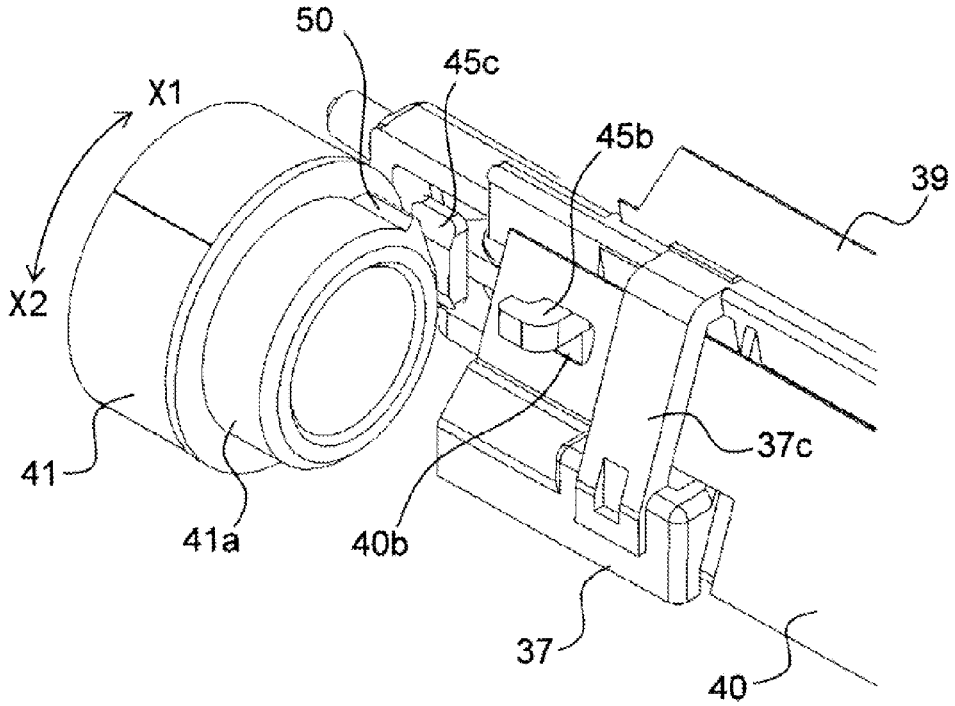
FIG. 6 is an enlarged view of a part around a rear-side end of the sleeve cover that is used in the developing device of the first embodiment.
Figure 7:
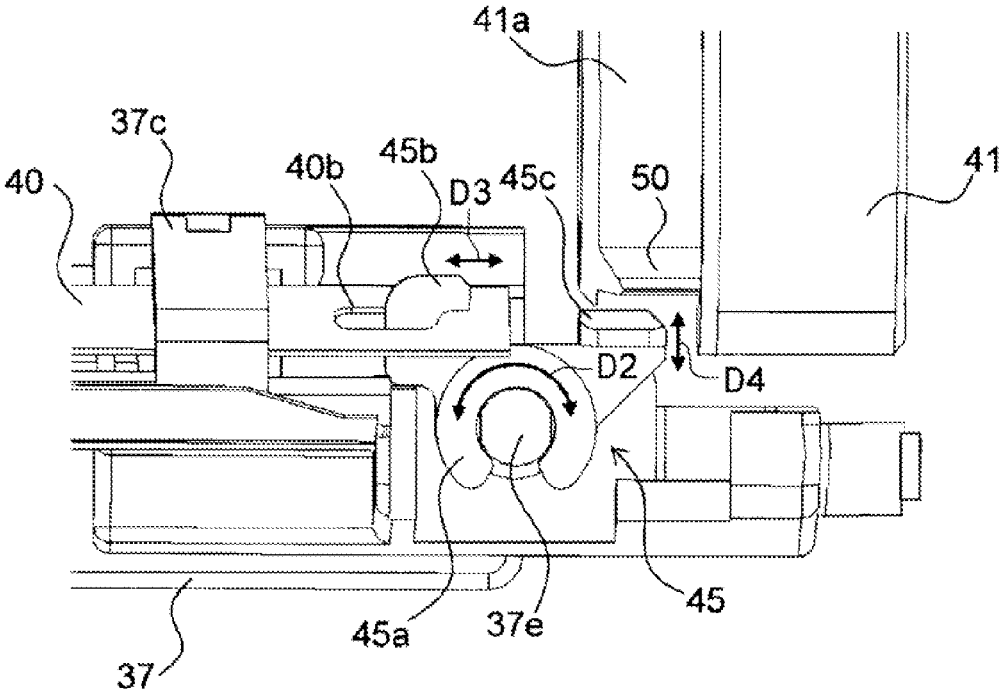
FIG. 7 is a top plan view of FIG. 6.

FIG. 5 is an enlarged view of a part around a front-side end of the sleeve cover 37 (within a dashed circle S1 in FIG. 4). FIG. 6 is an enlarged view of a part around the rear-side end of the film member 40 (within a dashed circle S2 in FIG. 4). FIG. 7 is a top plan view of FIG. 6. FIGS. 5 and 6 illustrate the sleeve cover 37 and the film member 40 as viewed from the interior (left-hand side of FIG. 3) of the developing device 3*a*.

At the front-side end of the sleeve cover 37, as illustrated in FIG. 5, one end of the film member 40 in terms of the longitudinal direction has an engagement hole 40*a*. One end of a coil spring 43 engages with the engagement hole 40*a*. The other end of the coil spring 43 engages with an engagement portion 37*d* of the sleeve cover 37. Thus, the coil spring 43 urges the one end (front-side end) of the film member 40 toward the front side. At the rear-side end of the sleeve cover 37, as illustrated in FIGS. 6 and 7, the other end of the film member 40 in terms of the longitudinal direction has a rectangular engagement hole 40*b*. A hook portion 45*b* of a linkage member 45 engages with the engagement hole 40*b*. Thus, the movement of the other end of the film member 40 is restricted by the hook portion 45*b*. Accordingly, predetermined tensile force (tension) is given to the film member 40 in the longitudinal direction of the film member 40 (in the axial direction of the development roller 31.

As illustrated in FIG. 7, the linkage member 45 has an arc-shaped support portion 45*a*, the hook portion 45*b* extending from the support portion 45*a*, and a trigger 45*c* extending from the support portion 45*a*. The support portion 45*a* is turnably received over a boss portion 37*e* formed in the sleeve cover 37. That is, the linkage member 45 is supported such as to be swingable about the boss portion 37*e* relative to the sleeve cover 37. In the example illustrated in FIG. 7, the linkage member 45 is swingable in directions indicated by arrow D2. In accompaniment to the linkage member 45 swinging in the directions indicated by arrow D2, the hook portion 45*b* moves in directions indicated by arrow D3, and the trigger 45*c* moves in directions indicated by arrow D4.

As illustrated in FIG. 6, the trigger 45*c* faces toward an outer circumferential surface of a cylindrical portion 41*a*. The cylindrical portion 41*a* is integrated with the idler gear 41 on a side facing the film member 40. The hook portion 45*b* engages with the engagement hole 40*b* of the film member 40. Thus, the urging force of the coil spring 43 acts on the linkage member 45 via the film member 40, urging the hook portion 45*b* toward the one end (front-side end) of the film member 40.

The outer circumferential surface of the cylindrical portion 41*a* has a peak-shaped protrusion 50. The protrusion 50 comes in contact with the trigger 45*c* as the cylindrical portion 41*a* rotates in accompaniment to the rotation of the idler gear 41.

The idler gear 41 rotates in a direction indicated by arrow X1 shown in FIG. 6 (an example of the first direction) in accompaniment to the rotation of the toner supply roller 30 and the development roller 31 during image formation. At the same time, the cylindrical portion 41*a* also rotates in the direction indicated by arrow X1. The protrusion 50 formed on the cylindrical portion 41*a* intermittently comes in contact with the trigger 45*c* while the cylindrical portion 41*a* is rotating.

The intermittent contact between the protrusion 50 and the trigger 45*c* causes the linkage member 45 to swing about the boss portion 37*e* as illustrated in FIG. 7. Thus, the hook portion 45*b* intermittently pulls the other end (rear-side end) of the film member 40 against the urging force of the coil spring 43. As a result, the film member 40 intermittently moves toward the rear side. Accordingly, the film member 40 reciprocates (slides) with a small amplitude and at a high frequency in the longitudinal direction thereof while causing expansion and contraction of the coil spring 43 connected with the one end (front-side end).

The frequency of the reciprocating movement of the film member 40 varies according to the number of protrusions 50. The amplitude of the reciprocating movement of the film member 40 varies according to the protrusion distance of each protrusion 50. That is, the amplitude, the frequency, and so on of the reciprocating movement of the film member 40 can be varied as appropriate by varying the protrusion distance of the protrusion 50 or the number of protrusions 50.

Figure 8:
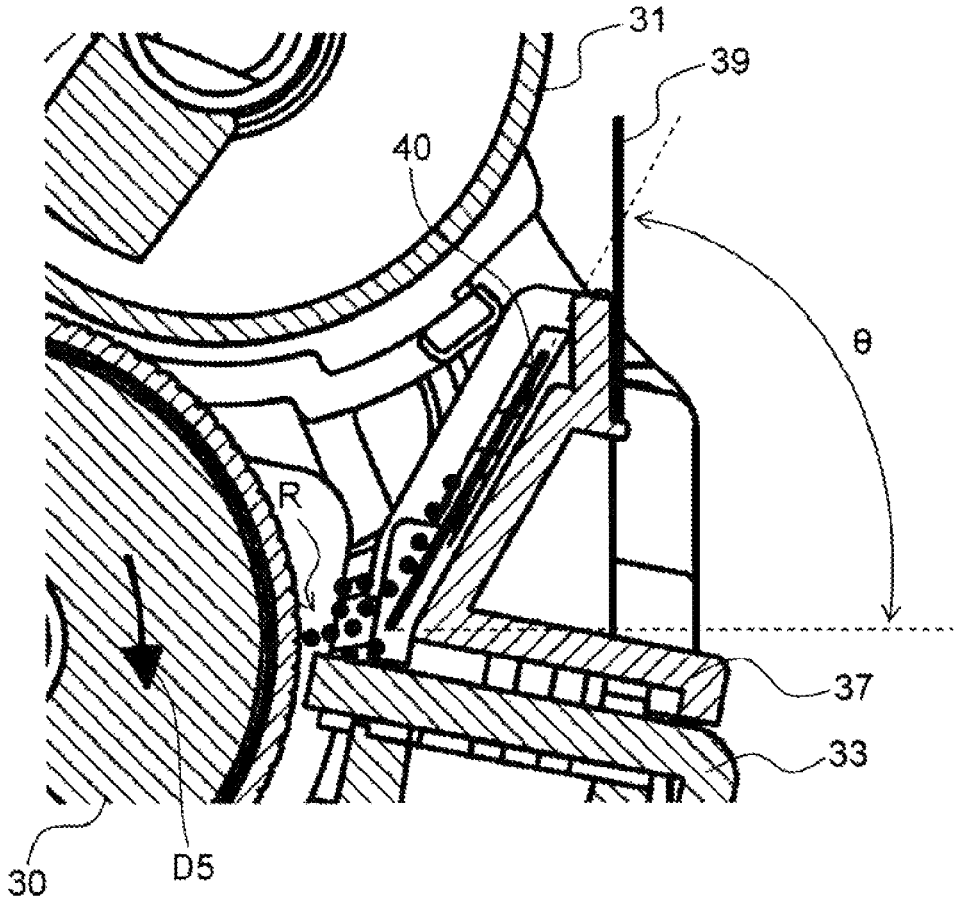
FIG. 8 is a cross-sectional side view of a part of the developing device of the first embodiment around the sleeve cover.

FIG. 8 is a cross-sectional side view of a part of the developing device 3*a* of the present embodiment around the sleeve cover 37. As illustrated in FIG. 8, the toner accumulated on the film member 40 is shaken off the film member 40 due to the above-described reciprocating movement of the film member 40. According to the present embodiment, the film member 40 reciprocates using the rotation of the idler gear 41 that is used for rotationally driving the toner supply roller 30 and the development roller 31. That is, the film member 40 reciprocates in accompaniment to the rotation of the toner supply roller 30 and the development roller 31. Therefore, even if the toner supply roller 30 and the development roller 31 in the developing device 3*a* rotate at a high speed and a large amount of toner cloud is generated in the developer container 20, accumulation of toner on the upper surface 37*a* of the sleeve cover 37 can be restricted. Toner accumulated on the upper surface 37*a* of the sleeve cover 37 may go through aggregation (blocking) and then adhere to the toner supply roller 30 or the development roller 31. If aggregated toner adheres to the toner supply roller 30 or the development roller 31, an image defect leading to toner peeling may occur. However, according to the present embodiment, toner slides along and falls off the film member 40 into a region R between the sleeve cover 37 and the toner supply roller 30 due to the reciprocating movement of the film member 40. As a result, the possibility of the image defect can be reduced effectively.

The entirety of the film member 40 reciprocates in the longitudinal direction of the film member 40. Accordingly, the effect of shaking off toner is consistent throughout the longitudinal direction of the film member 40 and it is possible to shake off toner accumulated on the film member 40 regardless of location on the film member 40. In order that toner accumulated on the film member 40 falls off smoothly, an angle of inclination θ of the film member 40 relative to the horizontal plane is preferably no less than 55°.

According to the present embodiment, the reciprocating movement of the film member 40 restricts accumulation of toner on the upper surface 37*a* of the sleeve cover 37. This configuration eliminates the need for a separate toner removing member such as a brush member that removes toner on the sleeve cover 37. As a result, the configuration of the color printer 100 is compact and space-saving. With the toner removing member, a foreign substance resulting from the toner removing member may be circulated together with the developer in the developer container 20. However, the present embodiment eliminates the need for the separate toner removing member. It is therefore possible to prevent a foreign substance resulting from the toner removing member from getting stuck between the bristle cutting blade 33 and the toner supply roller 30. Accordingly, a defective image such as an image with a void defect can be effectively avoided.

Furthermore, the film member 40 reciprocates using the rotation of the idler gear 41. This configuration eliminates the need for a dedicated motor, actuator, and so on for oscillating the film member 40. As a result, the internal configuration of the developing device 3*a* can be simplified.

During a time when image formation is not performed, the toner supply roller 30 is preferably driven to rotate in a reverse direction (in a clockwise direction in FIG. 8) that is opposite to the direction of the rotation thereof during image formation in order to return toner collected in the region R to the supplying conveyance chamber 22. That is, once in the region R, toner is temporarily accumulated around an edge of the bristle cutting blade 33 in terms of the lateral direction thereof and then collected by the magnetic brush formed on the surface of the toner supply roller 30 because of the rotation of the toner supply roller 30 in the reverse direction. The toner collected by the magnetic brush passes through the gap between the toner supply roller 30 and the bristle cutting blade 33 as the toner supply roller 30 rotates, and is separated from the toner supply roller 30 by the action of the region of the stationary magnetic body where adjacent homopolar magnetic poles are included. Consequently, the toner is forced back into the supplying conveyance chamber 22 (see FIG. 3).

Timing for driving the toner supply roller 30 to rotate in the reverse direction can be determined as appropriate according to the degree of the toner accumulation on the film member 40. For example, the timing may be when the color printer 100 is activated (turned on), when the color printer 100 is released from a power-saving (sleep) mode, or when printing has been performed on a predetermined number of sheets of paper.

When the toner supply roller 30 is driven to rotate in the reverse direction that is opposite to the rotation direction during image formation, the idler gear 41 also rotates in a reverse direction (an example of the second direction) that is opposite to the rotation direction thereof during image formation. In the example shown in FIG. 6, the idler gear 41 rotates in a direction indicated by arrow X2. Even in such a situation, the protrusion 50 formed on the cylindrical portion 41*a* intermittently comes in contact with the trigger 45*c* of the linkage member 45. Thus, the linkage member 45 can swing as in image formation, causing the reciprocating movement of the film member 40.

Although the present embodiment is described using a configuration in which the cylindrical portion 41*a* of the idler gear 41 has one protrusion 50 as an example, the number of protrusions 50 is not limited to one. The cylindrical portion 41*a* may have two or more protrusions 50.

Next, a second embodiment will be described focusing on differences thereof from the first embodiment with reference to FIGS. 9 and 10. The second embodiment has a different configuration from the first embodiment for the reciprocating movement of the film member 40.

Figure 9:
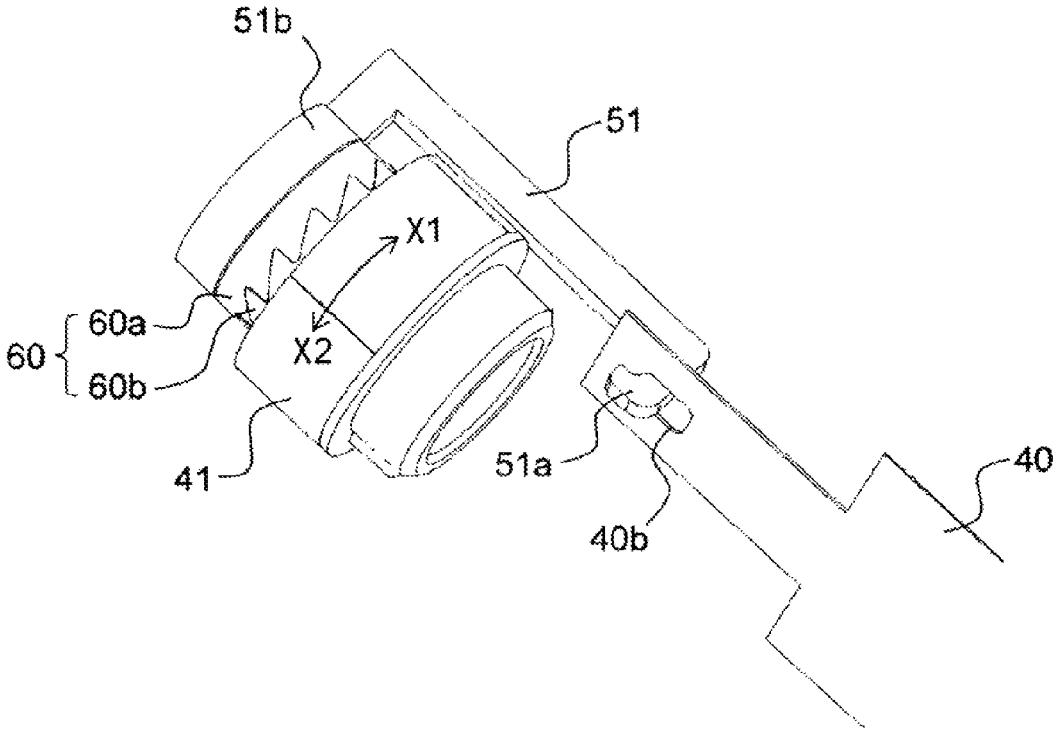
FIG. 9 is an enlarged perspective view of a part around a rear-side end of a sleeve cover that is used in a developing device according to a second embodiment of the present disclosure.

FIG. 9 is an enlarged view of a part around the rear-side end of the sleeve cover 37 that is used in the developing device 3*a* according to the second embodiment of the present disclosure. The configuration around the front-side end of the sleeve cover 37 is the same as that of the first embodiment illustrated in FIG. 5. As illustrated in FIG. 9, a hook portion 51 a of a link arm 51 engages with the engagement hole 40*b* of the film member 40 at the rear-side end of the sleeve cover 37.

As in the first embodiment, one end (front-side end) of the film member 40 is urged by the coil spring 43 (see FIG. 5) toward the front side. The movement of the other end (rear-side end) of the film member 40 is restricted by engagement between the engagement hole 40*b* and the link arm 51. Accordingly, predetermined tensile force (tension) is given to the film member 40 in the longitudinal direction of the film member 40.

The link arm 51 includes the hook portion 51*a* at one end and a disc-shaped gear supporting portion 51*b* at the other end. The hook portion 51*a* engages with the engagement hole 40*b* of the film member 40. The gear supporting portion 51*b* supports a ratchet gear 60*a* such that the gear is rotatable only in one direction (in a direction indicated by arrow X1 in FIG. 9). The gear supporting portion 51*b* faces a side surface of the idler gear 41 with the ratchet gear 60*a* and a ratchet gear 60*b* in meshing engagement with the ratchet gear 60*a* therebetween. As described above, the urging force of the coil spring 43 acts on the film member 40. The urging force of the coil spring 43 therefore acts on the gear supporting portion 51*b* via the film member 40. As a result, the gear supporting portion 51*b* is urged in a direction toward the idler gear 41.

Figure 10:
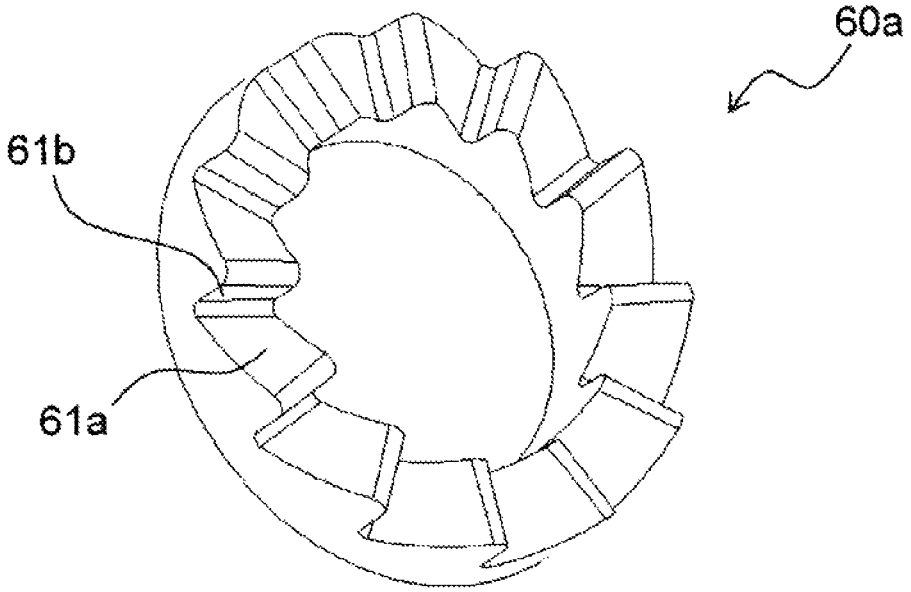
FIG. 10 is a perspective view of a ratchet gear that is attached to a link arm of the developing device of the second embodiment.

FIG. 10 is a perspective view of the ratchet gear 60*a*. The ratchet gear 60*a* includes less inclined first gear tooth flanks 61*a* and more inclined second gear tooth flanks 61*b* that are alternately arranged.

The ratchet gear 60*b* is fixed to the side surface of the idler gear 41 facing the gear supporting portion 51*b*. The ratchet gear 60*b* has the same configuration as the ratchet gear 60*a* illustrated in FIG. 10 except that the orientation of the first gear tooth flanks 61*a* and the orientation of the second gear tooth flanks 61*b* therein are different from those in the ratchet gear 60*a*. The profile (protrusion distance) or the number of the teeth of the ratchet gears 60*a* and 60*b* may be changed. The ratchet gears 60*a* and 60*b* form a ratchet mechanism 60 capable of transmitting driving force in only one direction (in a direction indicated by arrow X1 in FIG. 9).

The idler gear 41 rotates in the direction indicated by arrow X1 in FIG. 9 as the toner supply roller 30 and the development roller 31 are driven to rotate during the image formation. In the meantime, the ratchet gear 60*a* and the ratchet gear 60*b* integrally rotate in the direction indicated by arrow X1 with the more inclined second gear tooth flanks 61*b* of the respective ratchet gears in meshing engagement. Accordingly, the link arm 51 remains still without sliding.

The idler gear 41 rotates in a direction indicated by arrow X2 in FIG. 9 as the toner supply roller 30 and the development roller 31 are driven to rotate in the reverse direction during a time when image formation is not performed. In the meantime, the ratchet gear 60*a* and the ratchet gear 60*b* attempt to rotate in the direction indicated by arrow X2 with the less inclined first gear tooth flanks 61*a* of the respective ratchet gears in meshing engagement. However, as described above, the rotation of the ratchet gear 60*a* in the direction indicated by arrow X2 is restricted. The ratchet gear 60*a* therefore slides relative to the ratchet gear 60*b* with the first gear tooth flanks 61*a* of the ratchet gear 60*a* mounting the first gear tooth flanks 61*a* of the ratchet gear 60*b* against the urging force of the coil spring 43. The first gear tooth flanks 61*a* of the ratchet gear 60*a* then fall out of the first gear tooth flanks 61*a* of the ratchet gear 60*b*. The ratchet gear 60*a* repeats the above-described movement as long as the idler gear 41 is rotating. As a result, the gear supporting portion 51*b* swings in directions toward and away from the idler gear 41. Accordingly, the link arm 51 reciprocates in a longitudinal direction of the sleeve cover 37 with a small amplitude and at a high frequency.

According to this configuration, the other end (rear-side end) of the film member 40 is intermittently pulled by the hook portion 51*a*, and thus the film member 40 reciprocates in the longitudinal direction thereof while causing expansion and contraction of the coil spring 43 connected with the one end (front-side end) of the film member 40.

As illustrated in FIG. 8, toner accumulated on the film member 40 is shaken off the film member 40 due to the above-described reciprocating movement of the film member 40. Therefore, even if the toner supply roller 30 and the development roller 31 in the developing device 3*a* rotate at a high speed and a large amount of toner cloud is generated in the developer container 20, accumulation of toner on the upper surface 37*a* of the sleeve cover 37 can be restricted. The reciprocating movement of the film member 40 causes toner to slide along and fall off the film member 40 into the region R between the sleeve cover 37 and the toner supply roller 30.

Toner is temporarily accumulated around the edge of the bristle cutting blade 33 and then collected by the magnetic brush formed on the surface of the toner supply roller 30 because of the rotation of the toner supply roller 30 in a reverse direction (in a direction indicated by arrow D5 in FIG. 8) that is opposite to the rotation direction thereof during image formation. The toner collected by the magnetic brush passes through the gap between the toner supply roller 30 and the bristle cutting blade 33 as the toner supply roller 30 rotates. After passing through the gap between the toner supply roller 30 and the bristle cutting blade 33, the toner is separated from the toner supply roller 30 by the action of the region of the stationary magnetic body where adjacent homopolar magnetic poles are included. Thus, toner in the region R can be effectively returned to the supplying conveyance chamber 22. The description of the timing for driving the toner supply roller 30 to rotate in the reverse direction in the first embodiment applies to the second embodiment.

According to the present embodiment, the film member 40 reciprocates at an amplitude according to the protrusion distance of the teeth of the ratchet gears 60*a* and 60*b*. In addition, the film member 40 reciprocates at a frequency according to the number of the teeth of the ratchet gears 60*a* and 60*b*. That is, the amplitude, the frequency, and so on of the reciprocating movement of the film member 40 can be varied as appropriate by varying the protrusion distance or the number of the teeth of the ratchet gears 60*a* and 60*b*.

According to the present embodiment, the film member 40 does not oscillate during image formation. It is therefore possible to reduce toner peeling, which is an image defect that may occur when toner accumulated on the film member 40 scatters and adheres to the toner supply roller 30 or the development roller 31 during image formation.

Next, a third embodiment will be described focusing on differences thereof from the first embodiment with reference to FIGS. 11 and 12. The third embodiment is different from the first embodiment in that the film member 40 of the third embodiment is in contact with the seal member 39.

Figure 11:
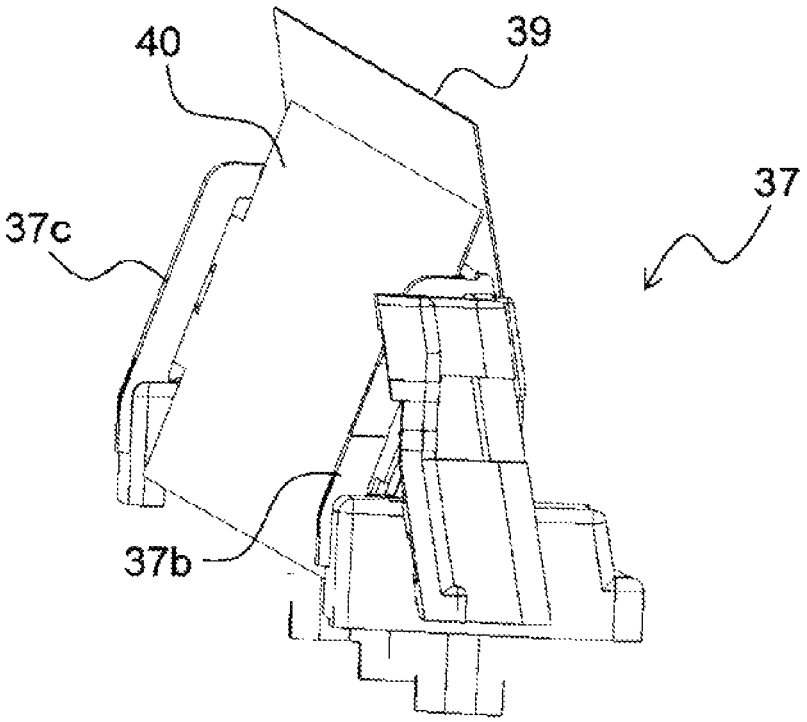
FIG. 11 is a perspective view of a part of a sleeve cover that is used in a developing device according to a third embodiment of the present disclosure.
Figure 12:
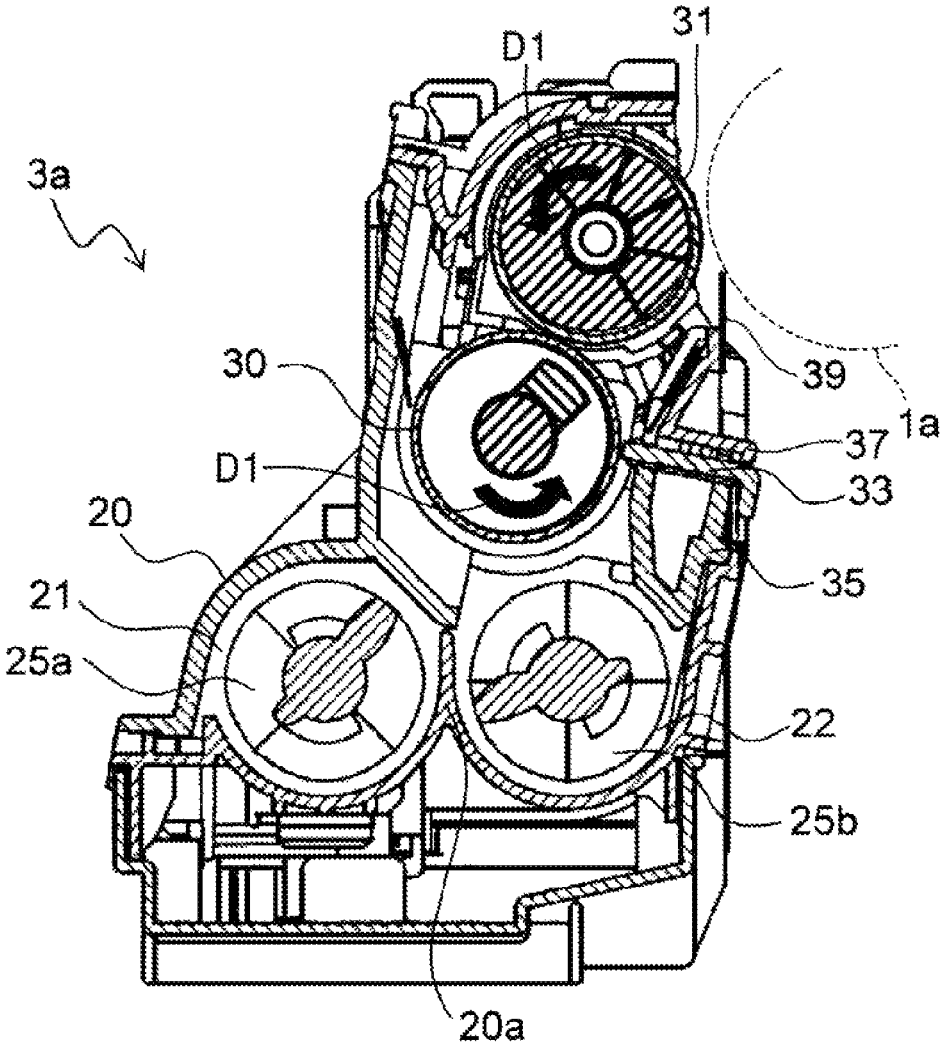
FIG. 12 is a cross-sectional side view of a developing device of the present disclosure in which the arrangement of a toner supply roller and a development roller is reversed to be opposite to that in FIG. 3.

FIG. 11 is a perspective view of a part of the sleeve cover 37 that is used in the developing device 3*a* according to the third embodiment of the present disclosure. In the present embodiment, an upper end of the film member 40 is extended upward to be in contact with the seal member 39. Although the idler gear 41, the coil spring 43, the linkage member 45, and some other elements are not shown in FIG. 11, the mechanism for the reciprocating movement of the film member 40 of the third embodiment is the same as that in the first embodiment. Therefore, description thereof is omitted.

According to the configuration of the present embodiment, the seal member 39 oscillates in accompaniment to the reciprocating movement of the film member 40 in the longitudinal direction. As a result, toner adhering to an inner surface (a left-front-side surface in FIG. 11) of the seal member 39 is shaken off, slides along and falls off the film member 40. Thus, the toner is forced back into the supplying conveyance chamber 22 (see FIG. 3). Accordingly, accumulation of toner that has flown to the seal member 39 can be also restricted. The link arm 51 and the ratchet mechanism 60 may be used as the mechanism for the reciprocating movement of the film member 40 as in the case of the second embodiment.

The present disclosure is not limited to the above-described embodiments. Various alterations can be made thereto within the scope without departing from the essence of the present disclosure. For example, the shapes and the configurations of the sleeve cover 37 and the film member 40 described in the embodiments above are merely examples, and are not particularly limited to those described in the embodiments. They may be determined as appropriate according to the configuration of the developing device 3*a*.

For example, the first embodiment is described using the configuration in which the protrusion 50 is formed on the idler gear 41 as an example. However, the present disclosure is not limited to the aforementioned configuration. For example, the protrusion 50 may be formed on any of the other gears included in the gear train for driving the toner supply roller 30 or the development roller 31.

The second embodiment is described using the configuration in which the ratchet gear 60*b* is disposed on the idler gear 41 as an example. However, the present disclosure is not limited to the configuration. For example, the ratchet gear 60*b* may be disposed on any of the other gears included in the gear train for driving the toner supply roller 30 or the development roller 31.

In the above-described embodiments, the present disclosure is applied to the developing devices 3*a* to 3*d* in which only toner is transferred from the toner supply rollers 30 to the development rollers 31 before subsequently being supplied from the development rollers 31 to the photosensitive drums 1*a* to 1*d*. However, the present disclosure is not limited to the embodiments. For example, as illustrated in FIG. 12, the arrangement of the rollers used as the development roller 31 and the toner supply roller 30 may be opposite to that of the above-described embodiments. In this configuration, the development rollers (magnetic rollers having the same configuration as the toner supply rollers 30 of the above-described embodiments) supply toner to the photosensitive drums 1*a* to 1*d*. More specifically, toner is supplied to the photosensitive drums 1*a* to 1*d* by magnetic brushes of two-component developers carried on the development rollers. In this configuration, the toner supply rollers (rollers having the same configurations as the development rollers 31 of the above-described embodiments) supply toner carried thereon to the development rollers and collect residual toner on the surfaces of the development rollers. This configuration also effectively restricts accumulation of toner coming off the development rollers 31 around the controlling blades 33 opposite to the toner supply rollers 30.

The embodiments are described above using the tandem color printer 100 as an example. However, the present disclosure can be of course applied to other types of image forming apparatuses such as monochrome and color copiers, digital multifunction peripherals, monochrome printers, and facsimile machines.

What is claimed is:

1. A developing device comprising:

a development roller disposed opposite to an image bearing member on which an electrostatic latent image is formed, the development roller having a first axis and being configured to supply a developer to the image bearing member while rotating about the first axis;

a toner supply roller disposed opposite to the development roller, the toner supply roller having a second axis parallel to the first axis and being configured to supply a toner to the development roller while rotating about the second axis;

a controlling blade disposed opposite to the toner supply roller with a predetermined gap therebetween;

a casing configured to provide accommodation for the development roller, the toner supply roller, and the controlling blade, the casing having an inner wall portion between the controlling blade and the image bearing member, the inner wall portion facing toward the development roller;

a flexible film member disposed on the inner wall portion and elongated in a direction of the first axis, the flexible film member having ends in the direction of the first axis that are opposite to each other;

an urging member connected with one of the ends of the film member and configured to pull the film member;

a linkage member connected with the other of the ends of the film member in the direction of the first axis; and a linkage member driving mechanism disposed on one gear of a gear train for driving the development roller or the toner supply roller, the linkage member driving mechanism being configured to intermittently drive the linkage member in accompaniment to rotation of the gear to intermittently pull the film member in a direction parallel to the direction of the first axis and opposite to a direction in which the urging member pulls the film member, so that the film member reciprocates in directions parallel to the direction of the first axis, wherein the linkage member is supported such as to be swingable relative to the casing, the linkage member driving mechanism includes at least one protrusion, the at least one protrusion intermittently comes in contact with the linkage member in accompaniment to the rotation of the gear, and the film member reciprocates at a frequency according to a number of the at least one protrusion.

2. The developing device according to claim 1, wherein the at least one protrusion is a plurality of protrusions.

3. The developing device according to claim 1, wherein the linkage member driving mechanism further includes a cylindrical portion integrated with the gear, the at least one protrusion is located on an outer circumferential surface of the cylindrical portion, and the film member reciprocates with an amplitude according to a protrusion distance of the at least one protrusion from the outer circumferential surface of the cylindrical portion.

4. The developing device according to claim 1, further comprising a sheet-like seal member disposed with an edge thereof in a direction perpendicular to the first axis in contact with a surface of the image bearing member, wherein an edge of the film member in the direction perpendicular to the first axis is in contact with the seal member.

5. The developing device according to claim 1, wherein the film member is disposed on the inner wall portion at an angle of inclination of no less than 55° relative to a horizontal plane.

6. The developing device according to claim 1, wherein the film member is formed from a material that is more resistant to toner adhesion than the inner wall portion.

7. The developing device according to claim 1, wherein the toner supply roller is a magnetic roller having a plurality of magnetic poles therein, and the toner supply roller carries a two-component developer including a toner and a carrier using the plurality of magnetic poles.

8. The developing device according to claim 1, wherein the development roller is a magnetic roller having a plurality of magnetic poles therein, and the development roller carries a two-component developer including a toner and a carrier using the plurality of magnetic poles.

9. An image forming apparatus comprising the developing device according to claim 1.

10. A developing device comprising:

a development roller disposed opposite to an image bearing member on which an electrostatic latent image is formed, the development roller having a first axis and being configured to supply a developer to the image bearing member while rotating about the first axis;

a toner supply roller disposed opposite to the development roller, the toner supply roller having a second axis parallel to the first axis and being configured to supply a toner to the development roller while rotating about the second axis;

a controlling blade disposed opposite to the toner supply roller with a predetermined gap therebetween;

a casing configured to provide accommodation for the development roller, the toner supply roller, and the controlling blade, the casing having an inner wall portion between the controlling blade and the image bearing member, the inner wall portion facing toward the development roller;

a flexible film member disposed on the inner wall portion and elongated in a direction of the first axis, the flexible film member having ends in the direction of the first axis that are opposite to each other;

an urging member connected with one of the ends of the film member and configured to pull the film member;

a linkage member connected with the other of the ends of the film member in the direction of the first axis; and a linkage member driving mechanism disposed on one gear of a gear train for driving the development roller or the toner supply roller, the linkage member driving mechanism being configured to intermittently drive the linkage member in accompaniment to rotation of the gear to intermittently pull the film member in a direction parallel to the direction of the first axis and opposite to a direction in which the urging member pulls the film member, so that the film member reciprocates in directions parallel to the direction of the first axis, wherein the gear rotates in a first direction for toner supply to the image bearing member by the development roller, and the film member reciprocates both when the gear rotates in the first direction and when the gear rotates in a second direction that is opposite to the first direction.

11. A developing device comprising:

a development roller disposed opposite to an image bearing member on which an electrostatic latent image is formed, the development roller having a first axis and being configured to supply a developer to the image bearing member while rotating about the first axis;

a toner supply roller disposed opposite to the development roller, the toner supply roller having a second axis parallel to the first axis and being configured to supply a toner to the development roller while rotating about the second axis;

a controlling blade disposed opposite to the toner supply roller with a predetermined gap therebetween;

a casing configured to provide accommodation for the development roller, the toner supply roller, and the controlling blade, the casing having an inner wall portion between the controlling blade and the image bearing member, the inner wall portion facing toward the development roller;

a flexible film member disposed on the inner wall portion and elongated in a direction of the first axis, the flexible film member having ends in the direction of the first axis that are opposite to each other;

an urging member connected with one of the ends of the film member and configured to pull the film member;

a linkage member connected with the other of the ends of the film member in the direction of the first axis; and a linkage member driving mechanism disposed on one gear of a gear train for driving the development roller or the toner supply roller, the linkage member driving mechanism being configured to intermittently drive the linkage member in accompaniment to rotation of the gear to intermittently pull the film member in a direction parallel to the direction of the first axis and opposite to a direction in which the urging member pulls the film member, so that the film member reciprocates in directions parallel to the direction of the first axis, wherein the linkage member includes a link arm that reciprocates in the directions parallel to the direction of the first axis, the linkage member driving mechanism includes a first ratchet gear and a second ratchet gear in meshing engagement, the link arm supports the first ratchet gear such that the first ratchet gear is rotatable only in a first direction, the second ratchet gear rotates in the first direction and in a second direction that is opposite to the first direction according to the rotation of the gear, the first ratchet gear and the second ratchet gear in meshing engagement integrally rotate in the first direction while the gear is rotating in the first direction, the first ratchet gear slides relative to the second ratchet gear to reciprocate in the directions parallel to the direction of the first axis while the gear is rotating in the second direction, and the first ratchet gear reciprocating in the directions parallel to the direction of the first axis causes the link arm to reciprocate in the directions parallel to the direction of the first axis.

12. The developing device according to claim 11, wherein the film member reciprocates with an amplitude according to a profile of teeth of the first ratchet gear and the second ratchet gear.

13. The developing device according to claim 11, wherein the film member reciprocates at a frequency according to a number of teeth of the first ratchet gear and the second ratchet gear.

* * * * *